US010661529B2

(12) United States Patent
Wildeman et al.

(10) Patent No.: US 10,661,529 B2
(45) Date of Patent: May 26, 2020

(54) CLEANING AND PERSONAL CARE ARTICLES

(75) Inventors: Martin Wildeman, Spartanburg, SC (US); Michelis Hardegree, Columbus, NC (US); William D. Bell, Inman, SC (US); Robert A. Johnson, Monroeville, NJ (US); David K. Osteen, Beaufort, SC (US); Wade Wallace, Greenville, SC (US)

(73) Assignee: TIETEX INTERNATIONAL LTD., Spartanburg, SC (US)

( * ) Notice: Subject to any disclaimer, the term of this patent is extended or adjusted under 35 U.S.C. 154(b) by 528 days.

(21) Appl. No.: 13/275,765

(22) Filed: Oct. 18, 2011

(65) Prior Publication Data

US 2012/0030893 A1 Feb. 9, 2012

Related U.S. Application Data

(62) Division of application No. 12/115,803, filed on May 6, 2008, now Pat. No. 8,060,973.

(Continued)

(51) Int. Cl.

*A47L 13/256* (2006.01)
*D04H 11/00* (2006.01)

(Continued)

(52) U.S. Cl.

CPC ..... *B32B 7/08* (2013.01); *A47L 13/20* (2013.01); *D04B 21/02* (2013.01); *D04B 21/165* (2013.01); *D04H 11/00* (2013.01); *D10B 2501/0632* (2013.01); *D10B 2503/00* (2013.01); *Y10T 428/2395* (2015.04); *Y10T 428/23929* (2015.04); *Y10T 428/23936* (2015.04);

(Continued)

(58) Field of Classification Search

CPC .. B32B 7/08; B32B 5/08; D04H 11/00; D04B 21/165; D04B 21/02; A47L 13/20; A47L 13/256; Y10T 428/24017; Y10T 428/23957; Y10T 428/23936; Y10T 428/23929; Y10T 428/23964; Y10T 428/23979; Y10T 428/2395; Y10T 442/643; Y10T 442/681; D10B 2503/00

USPC ..... 428/88, 89, 92, 95; 15/208, 209.1, 228

See application file for complete search history.

(56) References Cited

U.S. PATENT DOCUMENTS 3,976,525 A 8/1976 Mednick
4,321,095 A 3/1982 Argo et al.

(Continued)

FOREIGN PATENT DOCUMENTS

DE 29618285 U1 * 2/1997
JP 2003 190065 7/2003

(Continued)

OTHER PUBLICATIONS

EPO, EP, 08755101.6, Jun. 5, 2013.

(Continued)

*Primary Examiner* — Cheryl Juska
(74) *Attorney, Agent, or Firm* — J. M. Robertson, LLC

(57) ABSTRACT

A textile sheet element having selectively applied arrays of surface projection elements defining raised zones across an active surface for cleaning and/or personal care, The textile sheet element is adapted for use by itself and/or for attachment to a user manipulated support with or without a handle such as a mop head or the like.

3 Claims, 15 Drawing Sheets

Related U.S. Application Data

(60) Provisional application No. 60/927,990, filed on May 7, 2007.

(51) Int. Cl.

| | |
|---|---|
| ***B32B 5/08*** | (2006.01) |
| ***B32B 7/08*** | (2019.01) |
| ***D04B 21/16*** | (2006.01) |
| ***D04B 21/02*** | (2006.01) |
| ***A47L 13/20*** | (2006.01) |

(52) U.S. Cl.

CPC ..... *Y10T 428/23957* (2015.04); *Y10T 428/23964* (2015.04); *Y10T 428/23979* (2015.04); *Y10T 428/24017* (2015.01); *Y10T 442/643* (2015.04); *Y10T 442/681* (2015.04)

(56) References Cited

U.S. PATENT DOCUMENTS

| | | | | |
|---|---|---|---|---|
| 4,631,933 | A * | 12/1986 | Carey, Jr. | 66/192 |
| 4,675,226 | A * | 6/1987 | Ott | 428/102 |
| 4,931,343 | A | 6/1990 | Becker | |
| 5,308,673 | A * | 5/1994 | Tochacek et al. | 428/102 |
| 5,310,590 | A * | 5/1994 | Tochacek et al. | 428/102 |
| 5,368,668 | A * | 11/1994 | Tochacek et al. | 156/93 |
| 5,377,378 | A | 1/1995 | Cutler | |
| 5,804,274 | A * | 9/1998 | Nordin | 428/89 |
| 5,806,128 | A | 9/1998 | Love | |
| 5,902,757 | A * | 5/1999 | Stern et al. | 442/324 |
| 6,087,279 | A * | 7/2000 | Laun | 442/402 |
| 6,423,393 | B1 * | 7/2002 | Wildeman | 428/91 |
| 6,500,444 | B1 * | 12/2002 | Ferenc et al. | 424/404 |
| 6,855,392 | B2 * | 2/2005 | Wildeman et al. | 428/88 |
| 6,869,660 | B2 * | 3/2005 | Wildeman | 428/92 |
| 7,163,349 | B2 | 1/2007 | Policicchio et al. | |
| 7,273,648 | B2 * | 9/2007 | Morin et al. | 428/89 |
| 7,249,387 | B2 | 11/2007 | Wideman | |
| 7,578,023 | B2 * | 8/2009 | Olson | 15/228 |
| 7,875,334 | B2 * | 1/2011 | Zafiroglu et al. | 428/105 |
| 8,060,973 | B2 * | 11/2011 | Wildeman et al. | 15/209.1 |
| 8,281,451 | B2 * | 10/2012 | Adams et al. | 15/231 |
| 8,291,542 | B2 * | 10/2012 | Wildeman et al. | 15/244.3 |
| 8,809,213 | B2 * | 8/2014 | Wildeman et al. | 442/351 |
| 8,863,347 | B2 * | 10/2014 | Wildeman | 15/208 |
| 8,935,824 | B2 * | 1/2015 | Sears | 15/209.1 |
| 8,990,998 | B1 * | 3/2015 | McBride et al. | 15/228 |
| 9,049,974 | B2 * | 6/2015 | Wildeman | A47L 13/256 |
| 2002/0184723 | A1 | 12/2002 | Bishop | |
| 2003/0114820 | A1 * | 6/2003 | Wildeman | 604/383 |
| 2003/0121116 | A1 | 7/2003 | Keeck et al. | |
| 2003/0126710 | A1 | 7/2003 | Policicchio et al. | |
| 2004/0022992 | A1 * | 2/2004 | Wildeman | 428/92 |
| 2004/0074520 | A1 * | 4/2004 | Truong | A47L 13/20 134/6 |
| 2004/0115388 | A1 * | 6/2004 | Wildeman et al. | 428/95 |
| 2005/0033490 | A1 * | 2/2005 | Abelard et al. | 701/25 |
| 2005/0241095 | A1 * | 11/2005 | Olson | 15/228 |
| 2006/0137119 | A1 * | 6/2006 | Otsuka et al. | 15/104.002 |
| 2007/0101771 | A1 * | 5/2007 | Wildeman et al. | 66/169 R |
| 2008/0047089 | A1 * | 2/2008 | Sadovsky | 15/228 |
| 2008/0166520 | A1 * | 7/2008 | Zafiroglu et al. | 428/136 |
| 2010/0263152 | A1 * | 10/2010 | Wildeman | 15/228 |
| 2010/0263154 | A1 * | 10/2010 | Wildeman et al. | 15/244.4 |
| 2011/0117954 | A1 * | 5/2011 | Iwamura et al. | 455/525 |
| 2011/0146017 | A1 * | 6/2011 | Wildeman | 15/209.1 |
| 2012/0207652 | A1 * | 8/2012 | Wildeman et al. | 422/292 |
| 2013/0117954 | A1 * | 5/2013 | Sears | 15/223 |
| 2014/0352094 | A1 * | 12/2014 | Wildeman et al. | 15/209.1 |
| 2015/0033490 | A1 * | 2/2015 | Wildeman | 15/228 |
| 2015/0128370 | A1 * | 5/2015 | Sears | A47L 13/16 15/209.1 |
| 2015/0272418 | A1 * | 10/2015 | Wildeman | A47L 13/256 15/228 |

FOREIGN PATENT DOCUMENTS

| | | | |
|---|---|---|---|
| WO | WO 9749326 A1 * | 12/1997 | A47K 7/02 |
| WO | WO 98/57576 | 12/1998 | |
| WO | WO 2005/110182 | 11/2005 | |

OTHER PUBLICATIONS

ISA/US, PCT, PCT/US2008/062829, Sep. 18, 2008.
ISA/US, PCT, PCT/US2010/031580, Jul. 27, 2010.
U.S. Appl. No. 12/115,803, filed May 6, 2008.
International Search Report and Written Opinion for International Application No. PCT/US2010/031580.
International Search Report and Written Opinion for International Application No. PCT/US2008/062829.
European Search Report for Application No. EP08 75 5101.

* cited by examiner

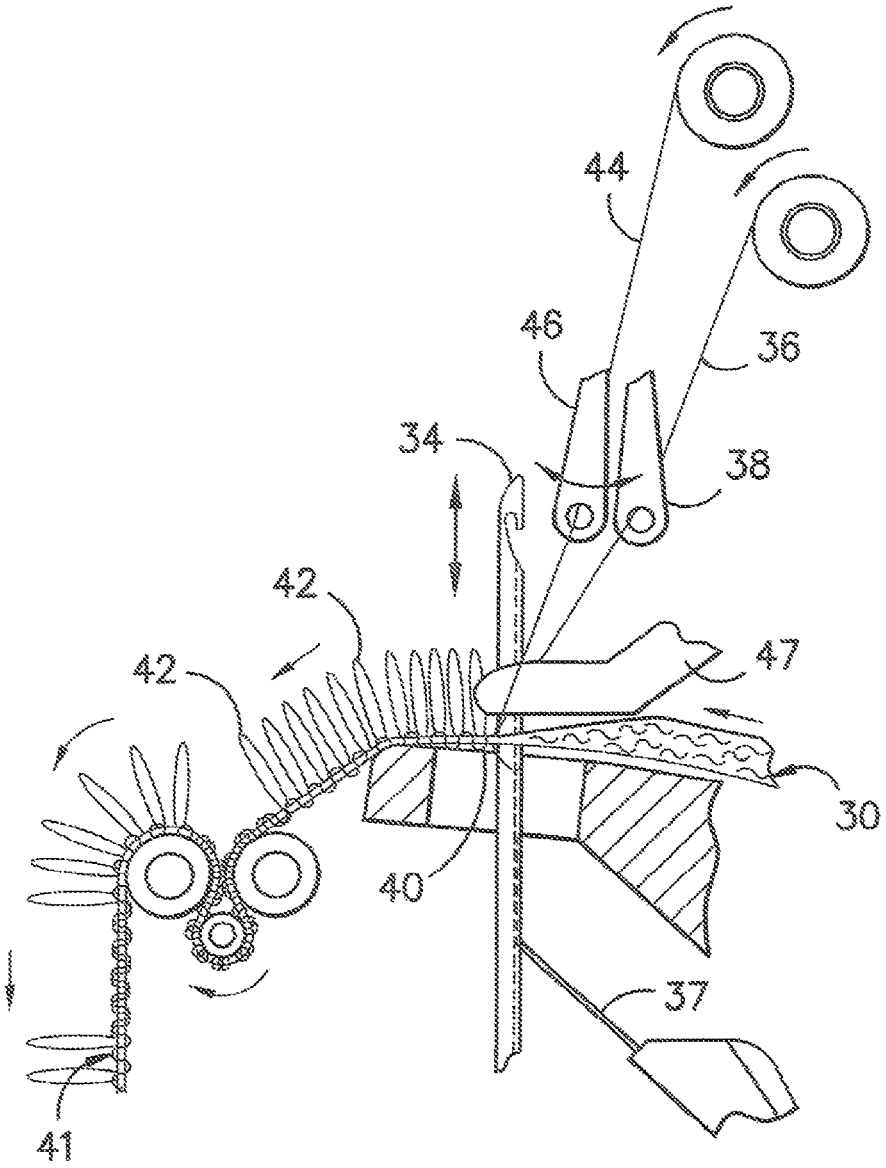
FIG. —1—

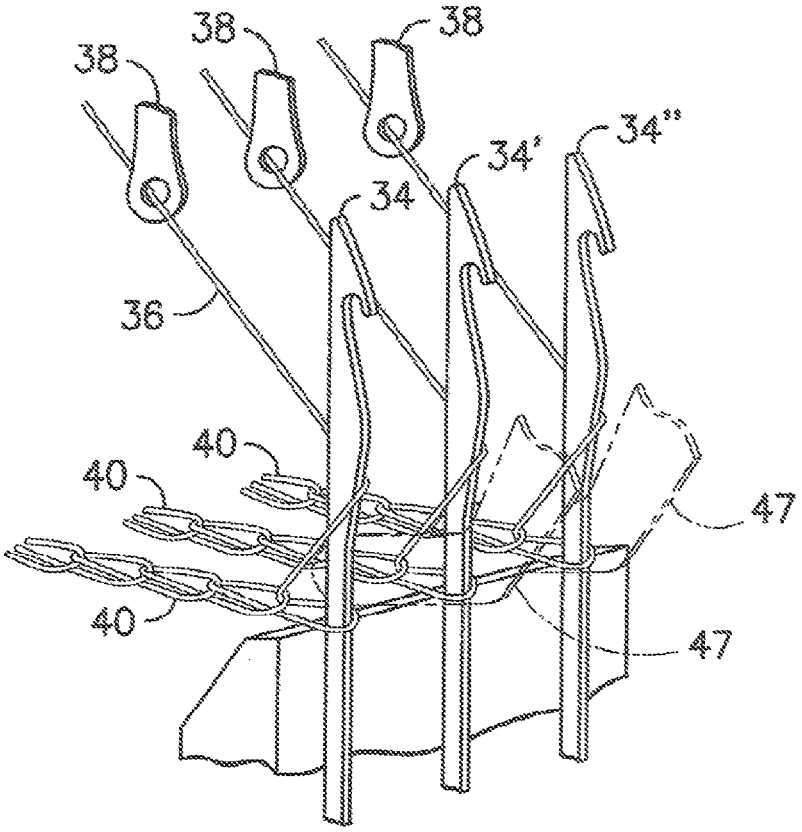
FIG. —2—
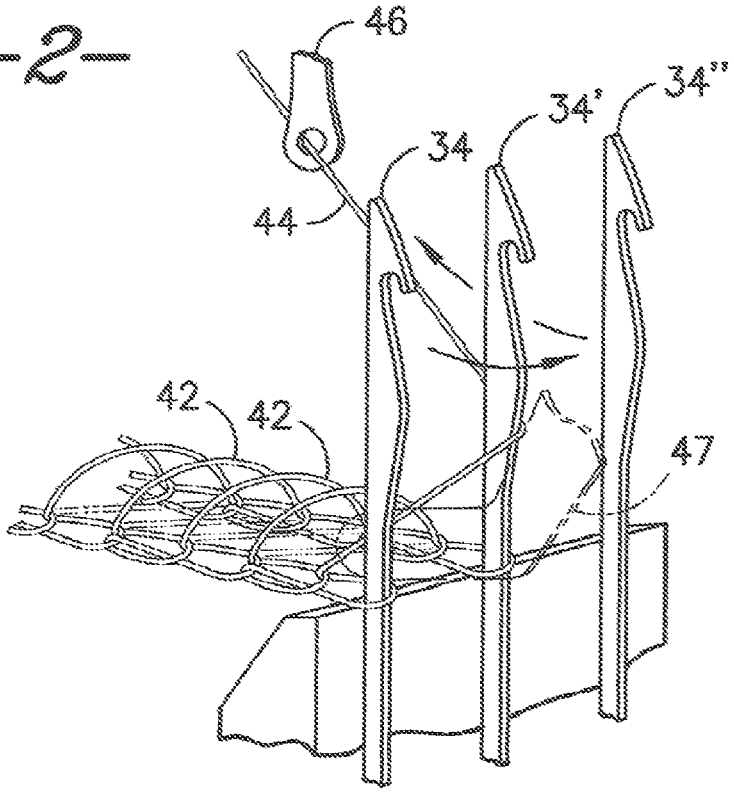
FIG. —3A—

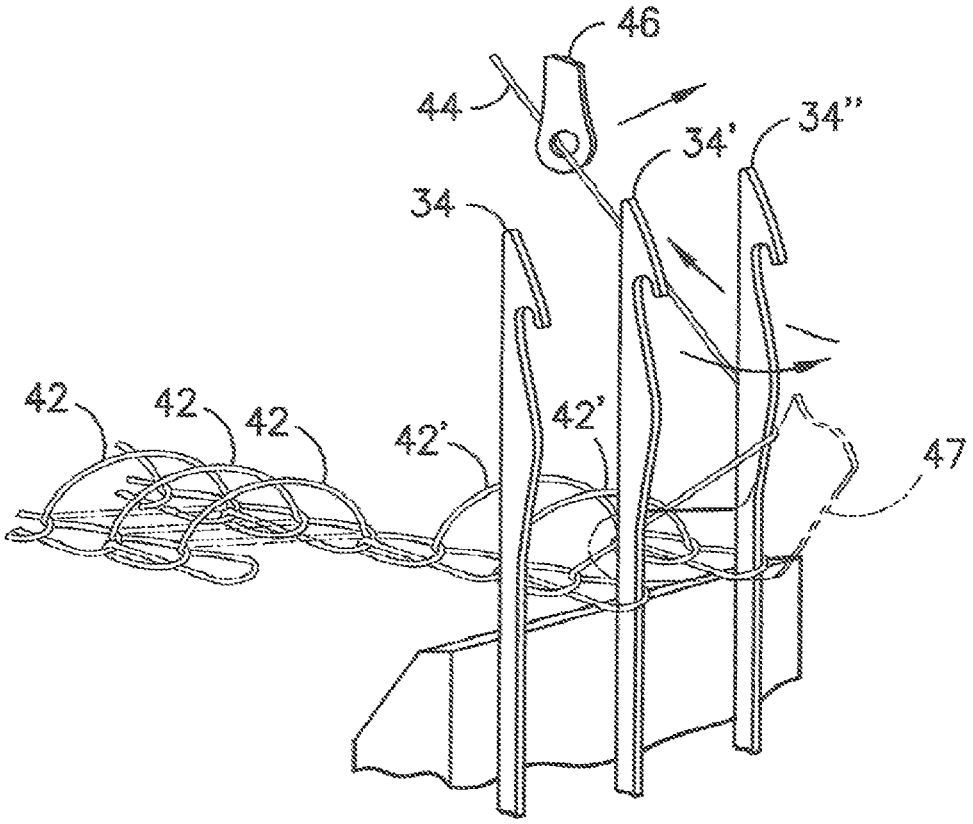
FIG. —3B—

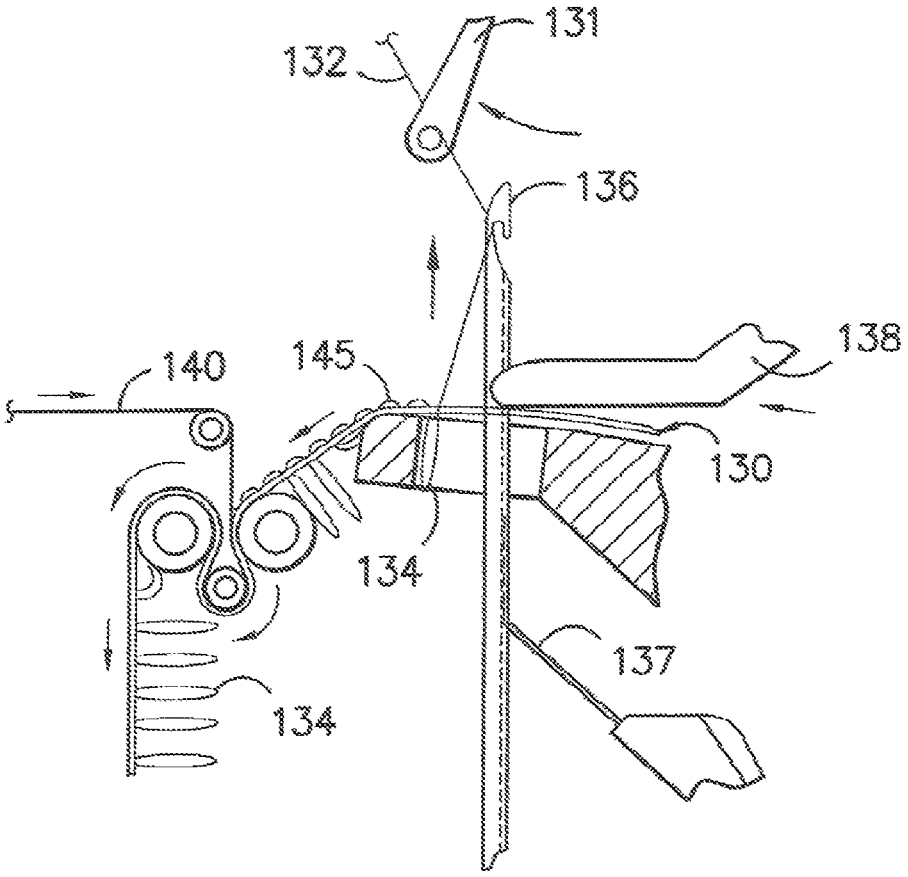
FIG. —4A—

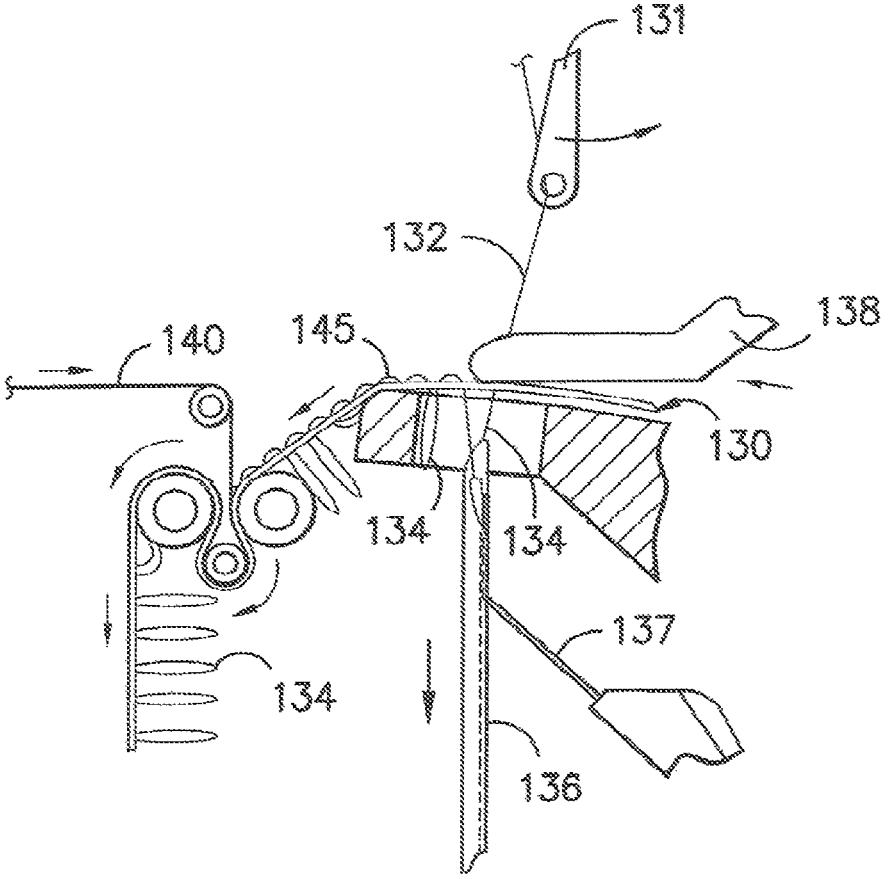
FIG. —4B—

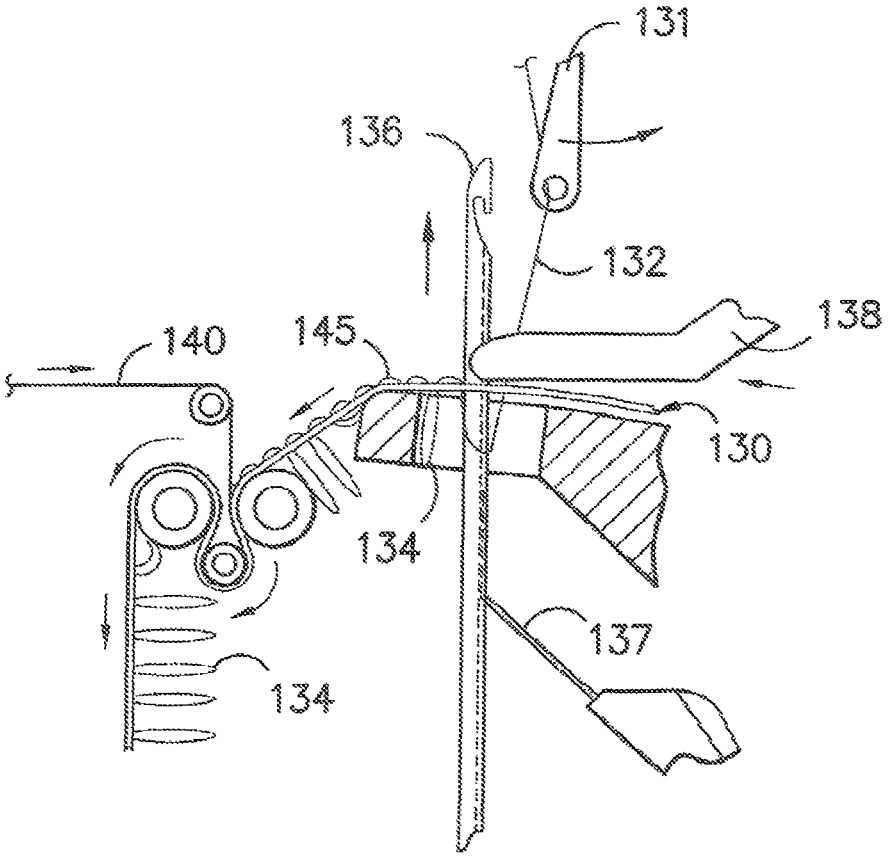
FIG. —4C—

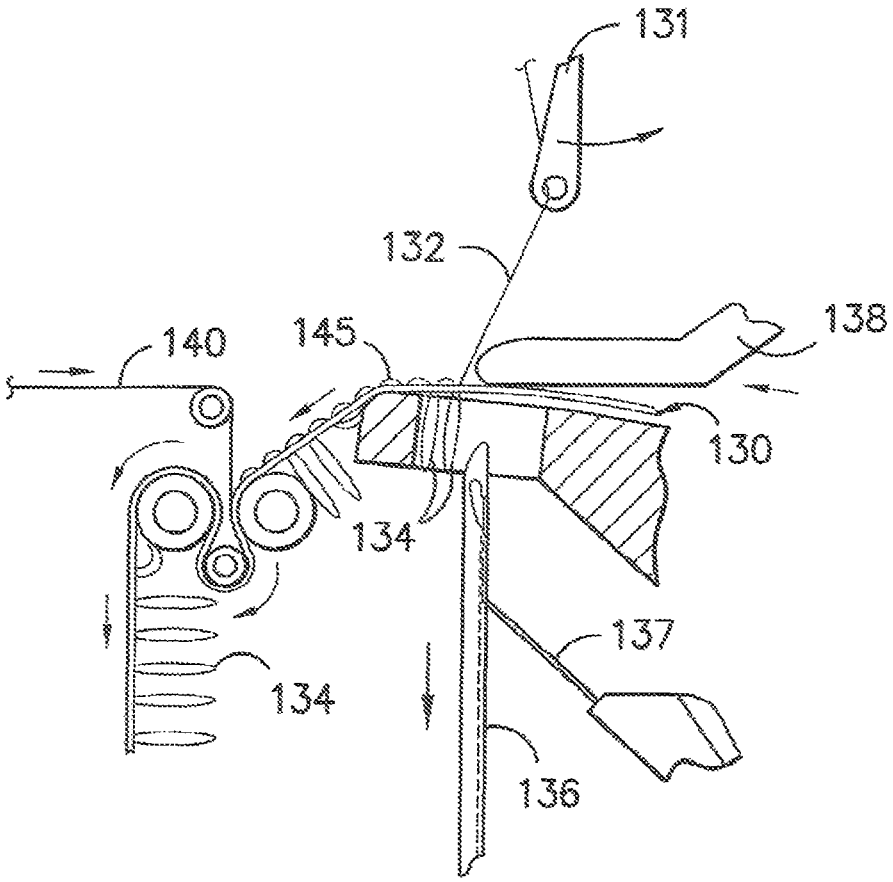
FIG. —4D—

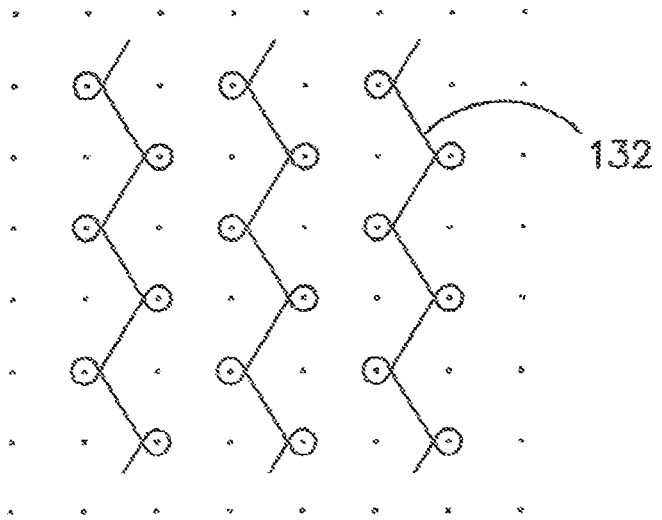
FIG. —5A—
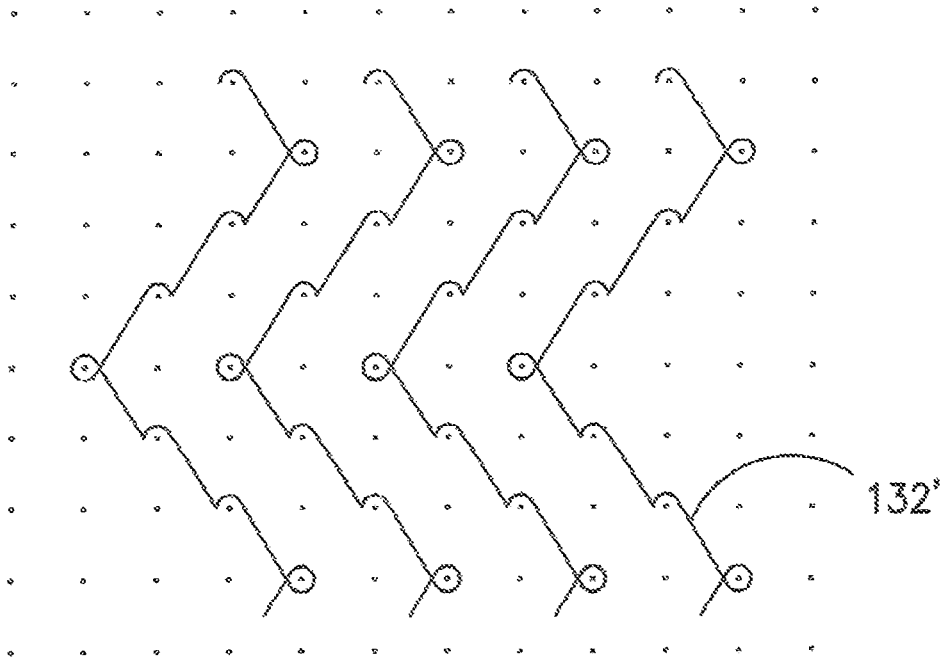
FIG. —5B—

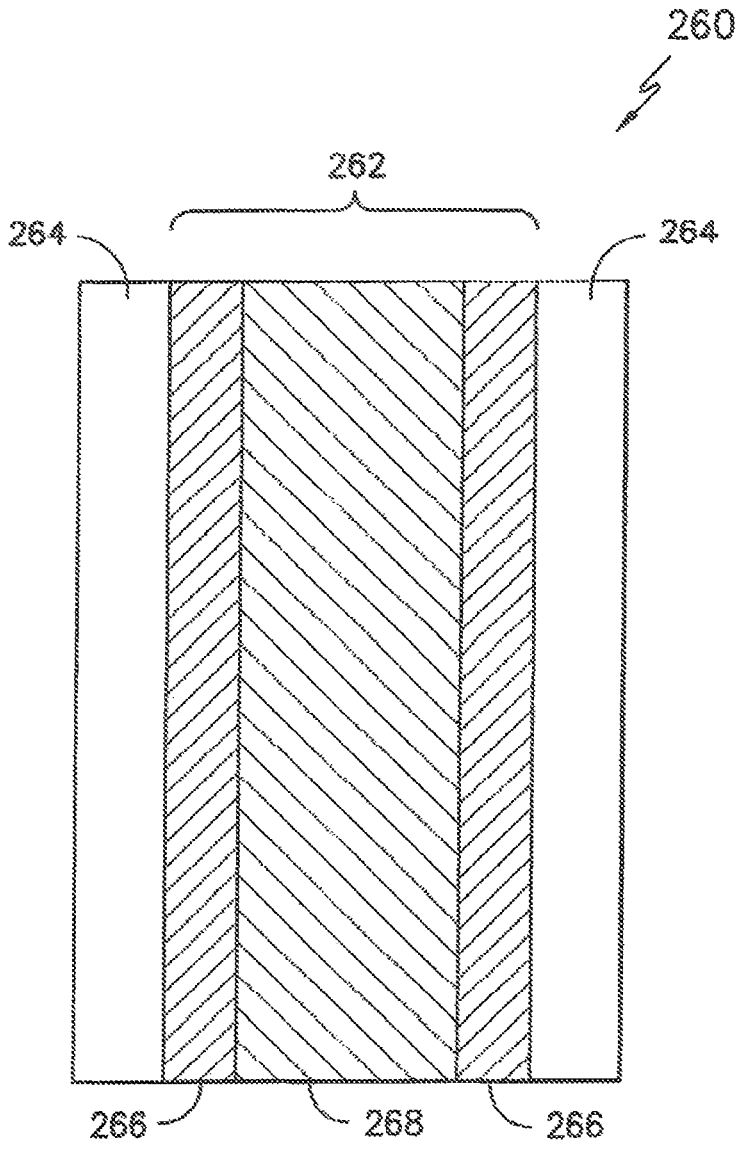
FIG. —6—

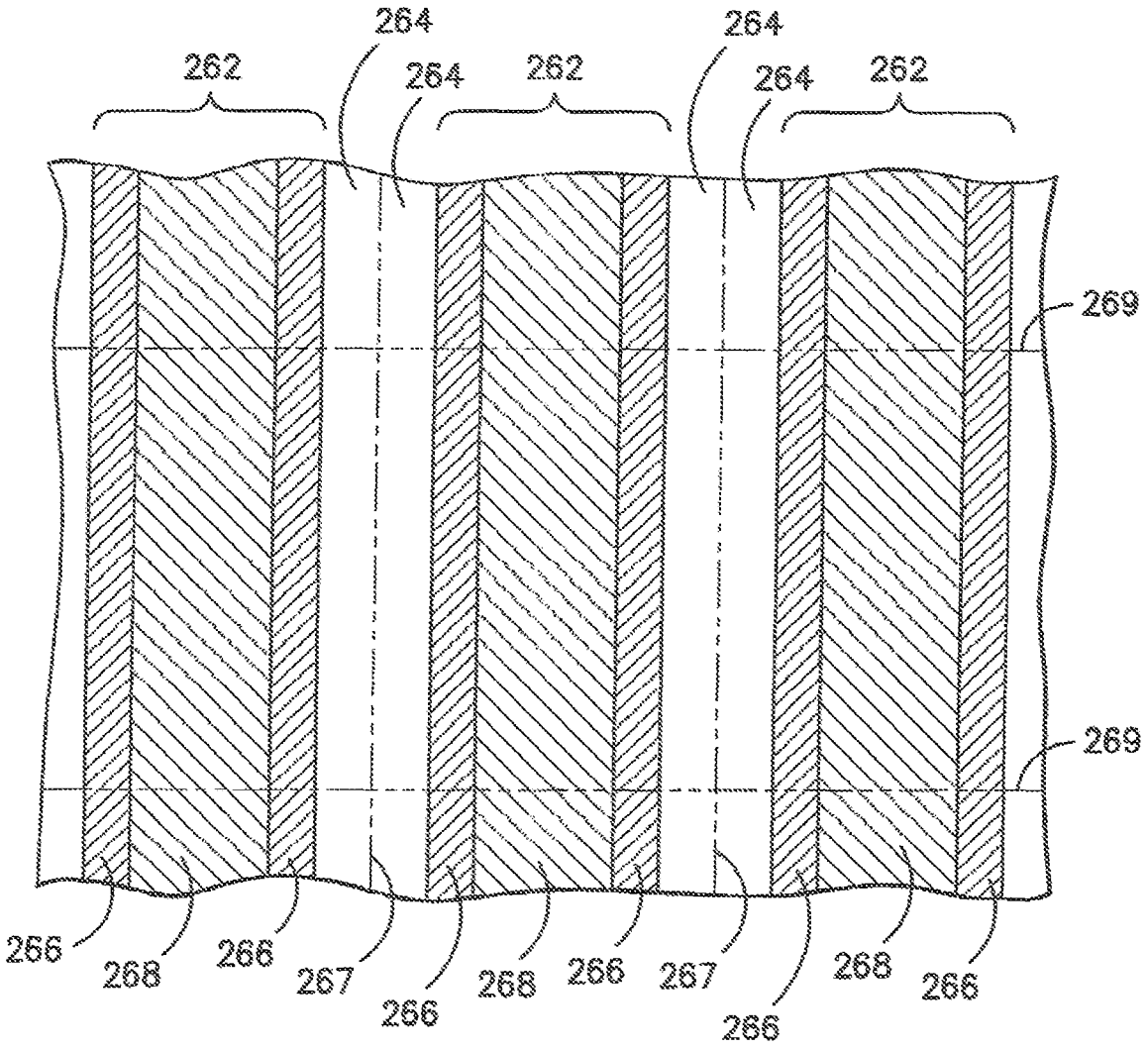
FIG. —7—

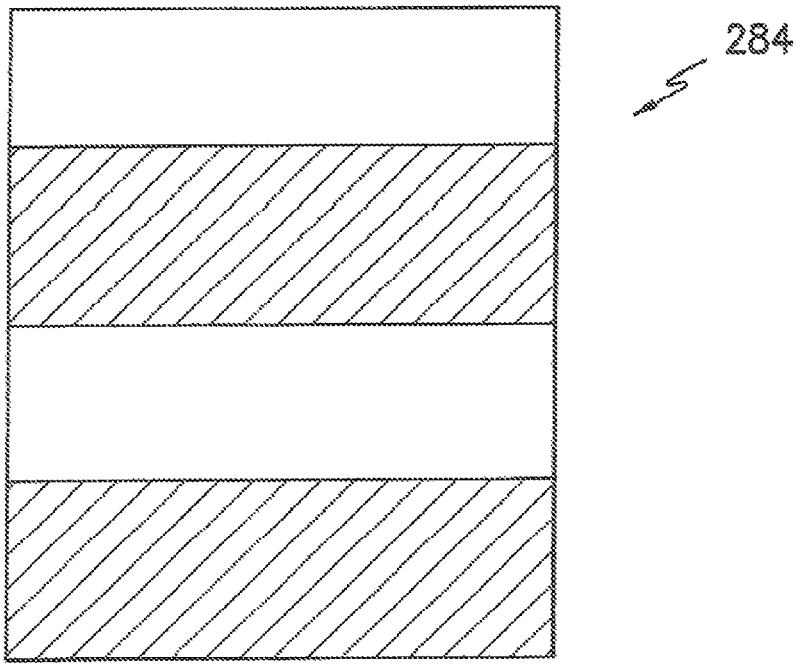
FIG. —9—
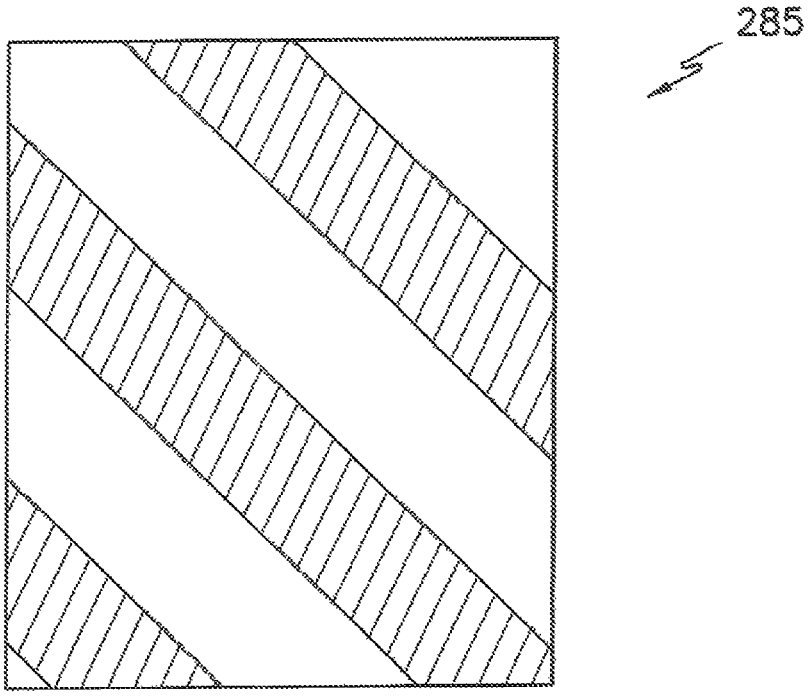
FIG. —10—

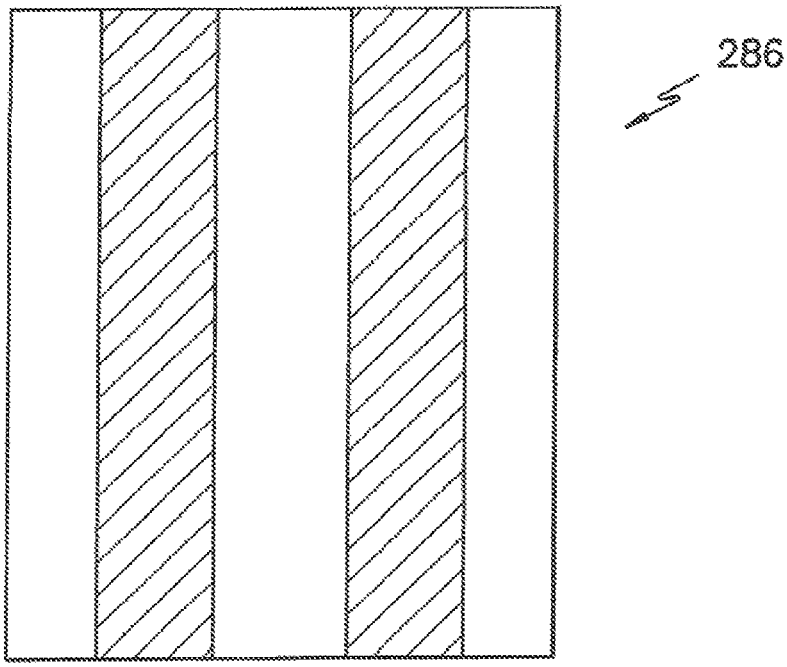
FIG. —11—
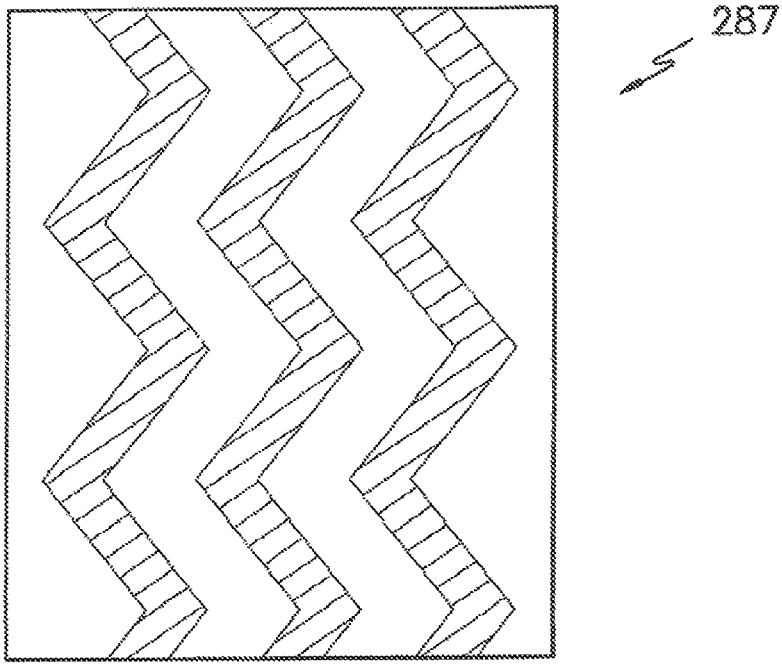
FIG. —12—

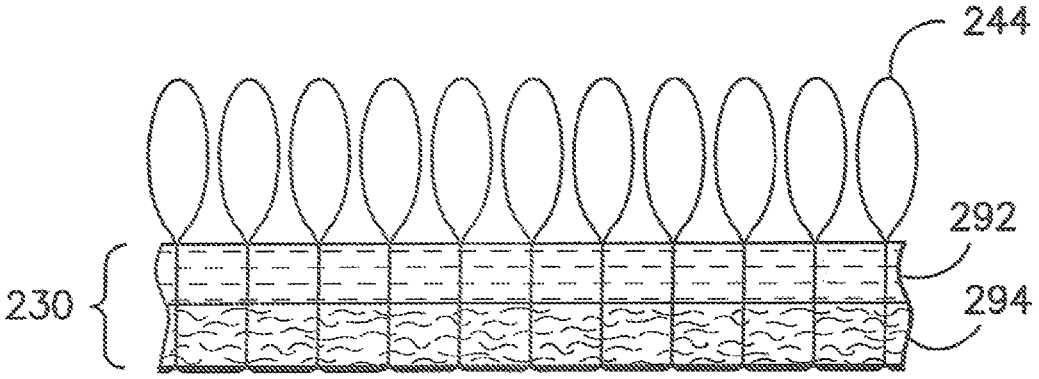
FIG. —14—
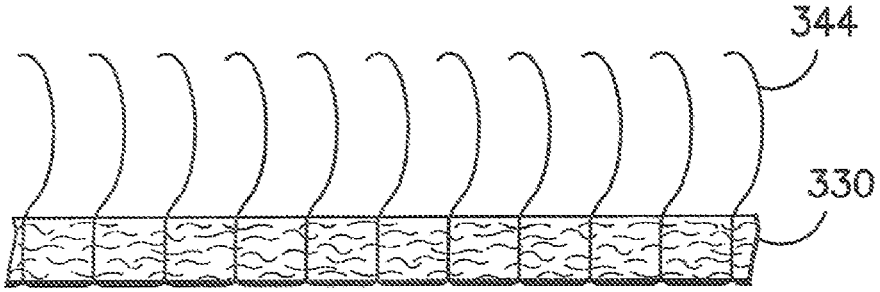
FIG. —15—

CLEANING AND PERSONAL CARE ARTICLES

CROSS-REFERENCE TO RELATED APPLICATIONS

This application claims the benefit of, and priority from, U.S. provisional application 60/927,990 filed May 7, 2007 and is a divisional of U.S. non-provisional application Ser. No. 12/115,803 filed May 6, 2008 now U.S. Pat. No. 8,060,973, the contents of all of which are hereby incorporated by reference in their entirety as if fully set forth herein.

TECHNICAL FIELD

The present invention relates generally to wipes or other articles including multi-purpose wipes or other implements adapted for household or personal care, and more particularly to wipes adapted for household or personal care formed from textile materials having an arrangement of elements projecting in a predefined pattern across an active surface. Such articles may be used alone and/or may be adapted for replaceable operative attachment to a user manipulated support with or without a handle. Exemplary non-limiting uses may include domestic or industrial cleaning of hard surfaces, floors, bathrooms, kitchens and the like. Additional exemplary uses may include personal care including application and/or removal of cosmetics, treatment solutions and the like to the face and/or body of a user.

BACKGROUND OF THE INVENTION

Cleaning and personal care sheet structures of various constructions are known. Such articles are often formed from one or more layers of cohesive, fibrous material such as a spun-lace nonwoven or the like. Texturing may be applied by embossing to apply patterns of raised and lowered zones across an active surface. Such raised and lowered zones provide added surface area for scrubbing, and/or particle collection and/or agent delivery. Such sheet structures may be secured to a mop head mandrel structure or other user manipulated device to facilitate use across a surface to be cleaned or treated. Following use, the sheet structures are typically thrown away.

Fabric formation using so-called stitch bonding techniques is well known. Such techniques include so-called Mailiwatt and Liba processes. In such processes, a multiplicity of stitching yarns is passed repeatedly in stitching relation through a substrate layer in closely spaced rows so as to form a coordinated arrangement of surface stitches in covering relation to the substrate. It is possible to use such stitch bonding techniques to form substantially uniform surfaces covered by the stitching yarns. It is also possible to impart intricate patterns of stitching yarns across the surface by manipulation of the formation process. By way of example only, and not limitation, techniques for development of such intricate patterns are disclosed in U.S. Pat. No. 6,855,392 to Wildeman et al. the contents of which are hereby incorporated by reference in their entirety. Such patterns may use upstanding loops, substantially flat stitches or combinations thereof.

SUMMARY OF THE INVENTION

The present invention provides advantages and/or alternatives over the prior art by providing a textile sheet element having selectively applied arrays of surface projection elements defining raised zones across an active surface for cleaning and/or personal care, The textile sheet element is adapted for use by itself and/or for attachment to a user manipulated support with or without a handle such as a mop head or the like.

According to one exemplary aspect, the sheet element may be a stitch bonded textile including stitching yarns extending through a substrate of predefined character such that portions of the stitching yarns form an array of loops or other projections disposed across at least one surface of the sheet element. The stitching yarns may be in either a substantially uniform arrangement or in a patterned arrangement across the surface. Combinations of various stitching yarns and/or stitch constructions may be used to provide discrete zones of variable character across the sheet element. The stitching yarns may provide a moisture wicking action when exposed to fluid. Application agents may be disposed uniformly or selectively across the sheet element if desired. Thus, the structure may be selectively adapted to provide either discrete functions or combinations of functions including scrubbing, particle collection, fluid collection, agent delivery and combinations thereof.

According to another exemplary aspect, the sheet element may be of a stitch bonded textile including stitching yarns extending through a substrate of predefined character such that portions of the stitching yarns form an array of non-looped projections disposed across at least one surface of the article. The stitching yarns may be in either a substantially uniform arrangement or in a patterned arrangement across the article. Combinations of various stitching yarns and/or stitch constructions may be used to provide discrete zones of variable character across the article. Application agents may likewise be disposed uniformly or selectively across the article. Thus, the article may be selectively adapted to provide either discrete functions or combinations of functions including scrubbing, particle collection, fluid collection, agent delivery and combinations thereof.

According to yet another exemplary aspect, the cleaning or personal care article may be of a stitch bonded textile including stitching yarns extending through a substrate of predefined character such that portions of the stitching yarns form an array of loops or other projecting elements in combination with flat zones and/or non-loop projections disposed across at least one surface of the article. The stitching yarns may be in either a substantially uniform arrangement or in a patterned arrangement across the article. Combinations of various stitching yarns and/or stitch constructions may be used to provide discrete zones of variable character across the article. Application agents may likewise be disposed uniformly or selectively across the article. Thus, the article may be selectively adapted to provide either discrete functions or combinations of functions including scrubbing, particle collection, fluid collection, agent delivery and combinations thereof.

According to one exemplary feature, a sheet structure may be provided incorporating a multiplicity of stitching yarns extending through a substrate with portions of the stitching yarns projecting outwardly across at least one surface of the sheet structure to define a cleaning surface. The stitch pattern may be such that portions of the stitching yarns substantially cover the cleaning surface. It is also contemplated that the stitch yarns may be arranged in a variable pattern across the cleaning surface. Different yarns or combinations of yarns may be utilized at different zones across the surface to provide variable character across the surface. The portions of the stitching yarns projecting across the cleaning surface may be in the form of raised loops, cut loops, flat stitches and other structures including twisted structures, heat shrunk node structures and combinations thereof.

According to another exemplary feature, the stitching yarns may be disposed through the substrate layer in a so called "drop stitch" construction with a polymer locking layer at least partially surrounding portions of the stitching yarns disposed below a substrate layer thereby locking the stitching yarns in place.

According to another exemplary feature, portions of the stitching yarns may define hook or loop attachment structures for complimentary connection to portions of a user manipulated support.

According to another exemplary feature, at least a portion of the stitching yarns may be multi-component yarns such as multi-ply yarns. The various components within the yarns may have different characteristics such as different sorbency, stiffness or other features to provide a desired combination of scrubbing, absorption and/or desorption for use at defined zones within the article.

According to another exemplary feature, at least a portion of the stitching yarns may incorporate combinations of fibers such as PET and nylon to produce a triboelectric effect so as to promote dust attraction and retention.

According to another exemplary feature, at least a portion of the stitching yarns at defined zones across the article may be heat shrunk POY or the like to increase the abrasiveness of the stitching yarns thereby producing localized scouring zones.

According to another exemplary feature, combinations of substrates of defined character may be utilized including layers of substrates with different sorbency characteristics and or different pore structures to retain or pass moisture and particles as may be desired.

According to another exemplary feature, a sheet structure may be provided incorporating a multiplicity of outwardly projecting micro denier yarn elements defining a cleaning or personal care surface.

According to another exemplary feature, at least a portion of the stitching yarns at defined zones across the cleaning article may incorporate a multi-lobal perimeter contour to promote wicking and particle capture.

According to another exemplary feature, the article may incorporate a localized active cleaning zone defined by the presence of cleaning surface stitching yarns with outboard attachment zones substantially devoid of cleaning surface stitching yarns for connection to the support structure.

According to another exemplary feature, at least a portion of the stitching yarns at defined zones across the article may crimped or hook shaped to promote particle retention.

According to another exemplary feature, the article may incorporate agent reservoirs at the yarns and/or at the interior substrate for expulsion of previously introduced retained agents such as cleaning solutions, personal care solutions, cosmetics and the like such that the article acts as an applicator.

BRIEF DESCRIPTION OF THE DRAWINGS

The accompanying drawings which are incorporated in and which constitute a part of this specification illustrate several exemplary constructions and procedures in accordance with the present invention and, together with the general description of the invention given above and the detailed description set forth below, serve to explain the principles of the invention wherein:

FIG. 1 illustrates schematically a two bar stitch bonding process for selectively forming a patterned surface yarn system and a cooperating ground yarn system through a fibrous substrate;

FIG. 2 illustrates schematically the stitching of a ground yarn in an arrangement of substantially flat chain stitches by a multiplicity of reciprocating needles;

FIG. 3A illustrates schematically the stitching of a surface yarn in a pattern of loops by a first pair of cooperating reciprocating needles;

FIG. 3B illustrates schematically the stitching of the surface yarn of FIG. 3A in a pattern of loops by a second pair of cooperating reciprocating needles after the surface yarn is shifted laterally one needle;

FIGS. 4A-4D illustrate steps in a practice wherein yarns are pulled through a lightweight substrate to form looped node structures across a substrate without an interlocking stitched relation between the nodes;

FIG. 5A is one exemplary needle point diagram illustrating a pattern utilized to form looped nodes across a substrate using the practice as set forth in FIGS. 4A-4D;

FIG. 5B is one exemplary needle point diagram illustrating a pattern utilized to form looped nodes across a substrate using the practice as set forth in FIGS. 4A-4D;

FIG. 6 is plan view of an exemplary wipe or other sheet structure showing variable zones across the surface;

FIG. 7 is a partial plan view of a production fabric structure illustrating segmentation lines for cutting individual wipes or other sheet structures;

FIGS. 9-12 are schematic views illustrating exemplary patterns of loops across a portion of a wipe or other sheet structure;

FIG. 14 illustrates an arrangement of stitching yarns running through a multi-layer substrate; and FIG. 15 illustrates an exemplary non-looped surface yarn profile.

Figure 8:
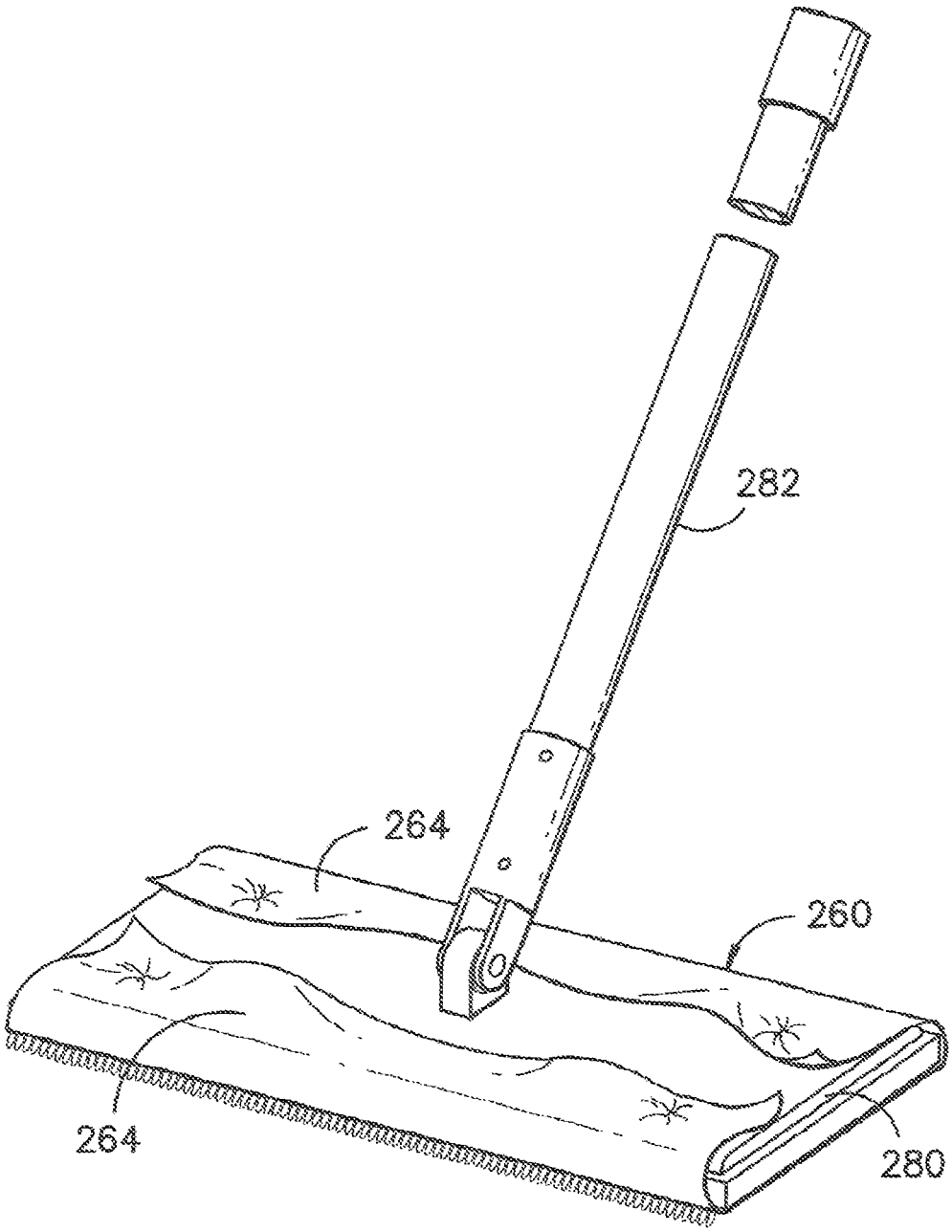
FIG. 8 illustrates an exemplary sheet structure of FIG. 8 in affixed relation to a mop head.

While the invention has been illustrated and will hereinafter be described in connection with certain exemplary embodiments and practices, it is to be understood that in no event is the invention to be limited to such illustrated and described embodiments and practices. On the contrary, it is intended that the present invention shall extend to all alternatives and modifications as may embrace the general principles of this invention within the full and true spirit and scope thereof.

DESCRIPTION OF THE PREFERRED EMBODIMENTS

Turning now to the drawings, one method utilized to form a patterned pile material of stitch bonded construction is illustrated schematically in FIG. 1. In the illustrated practice, a substrate material 30 such as a carded and cross-lapped fleece or a needle punched or spunbonded fleece is conveyed to a stitch-forming position in the direction indicated by the arrow. If desired, the substrate material 30 may include a percentage of low melting point fibers such as low melting point polyester or bicomponent polyester having a core of relatively high melting point material and a sheath of lower melting point polyester to facilitate heat activated point bonding so as to enhance structural integrity. It is also contemplated that the substrate material may be a material such as netting, paper, plastic film or the like. By way of example only, and not limitation, one suitable substrate is a relatively lightweight spunbond web of polypropylene having a mass per unit area of about 10 to about 25 grams per square meter. However, other materials and/or different weights may likewise be used if desired.

While a single layer of substrate material is illustrated, it is likewise contemplated that multiple layers may be used if desired. By way of example only, and not limitation, it is contemplated that one layer may be a substantially hydrophobic fibrous material for passage of fluid while an underlying layer may be a substantially hydrophilic material for retention of fluid. It is also contemplated that materials of different pore size may be used. By way of example only, and not limitation, it is contemplated that one layer may have a relatively open structure adequate for particle retention, while another layer may incorporate fine pores to promote absorbency. Of course, any combination of these features may be utilized.

Regardless of the substrate structure utilized, as illustrated through joint reference to FIGS. 1, 2, 3A and 3B, the stitch forming position is defined by a row of reciprocating needles 34, 34', 34" etc. extending in adjacent relation to one another across the width of the substrate material 30 substantially transverse to the direction of movement of the substrate material 30. As will be appreciated, while only three needles have been illustrated, in actual practice a large number of such needles are arranged in close relation to one another in the cross machine direction between the fingers 47 of a sinker bar. It is contemplated that the so called gauge or needle density in the cross machine direction may be adjusted as desired. By way of example only, and not limitation, it is contemplated that the needle density may be in the range of about 7 to about 28 needles per inch and more preferably about 14 to about 18 needles per inch although higher and lower needle densities may likewise be used if desired.

According to the illustrated practice, two yarns systems (i.e. two bars) are used to form stitches through the substrate material 30. However, it is also contemplated that one bar or three bar systems may likewise be utilized. In the illustrated two bar practice, a ground yarn 36 (FIG. 2) is carried through a first set of moveable yarn guides 38 carried by a first guide bar (not shown) for cooperative substantially fully threaded engagement with the needles 34, 34', 34" etc. across the width of the substrate material 30. For ease of reference, the substrate material 30 is not illustrated in FIG. 2.

As will be appreciated by those of skill in the art, in operation the ground yarn 36 is moved into engagement with the needles which, in turn, carry the ground yarn 36 in a reciprocating manner through the substrate material 30 without engaging finger elements 47 of the sinker bar so as to form an arrangement of cooperating ground yarn stitches 40 extending in relatively closely spaced rows along the substrate material 30. By way of example only, and not limitation, the cooperating ground yarn stitches 40 may be held in a full chain stitch configuration although other stitch arrangements including tricot stitches and the like may likewise be utilized if desired. Preferably, the spacing of the stitch lines formed by the ground yarn 36 will be close enough that the ground yarn stitches 40 define a substantially continuous covering across the technical back 41 of the substrate material 30. The ground yarn 36 and the substrate material 30 thus define a substantially stable stitch bonded structure. By way of example only, and not limitation, the ground yarn 36 may having a linear density of about 20 denier to about 300 denier. One such suitable yarn is a 70 denier, 34 filament flat continuous filament polyester yarn although other yarn constructions may likewise be utilized if desired.

In order to impart controlled pile patterning, an arrangement of loop elements 42 may be selectively formed projecting away from and standing above the ground yarn stitches 40 in a predefined pattern across the technical back 41 of the fabric. According to a preferred practice, the loop elements 42 may be formed substantially concurrently with the formation of the ground yarn stitches 40 through the substrate material 30.

One technique for forming a pattern of loop elements 42 is illustrated in FIGS. 3A and 3B wherein the substrate material 30 and ground yarn 36 have been eliminated for ease of reference. According to this practice, loop elements 42 may be formed in a pattern by a pile yarn 44 threaded through moveable yarn guides 46 carried by a guide bar (not shown). As illustrated, in this practice the pile yarn 44 may be partially threaded relative to the needles. That is, at least a portion of the needles may be free from engagement by the pile yarn. While only a single pile yarn 44 is illustrated for explanatory purposes, it is to be understood that in actual practice, multiple pile yarns 44 are used across the width of the fabric threaded in a pattern relative to the needles to impart a desired patterned arrangement. Of course, a fully threaded arrangement may also be used in which each of the needles is engaged by a cooperating pile yarn. In such a fully threaded arrangement the pile yarns 44 will form a substantially continuous pattern of loop elements 42. By way of example only, and not limitation, the pile yarns 44 may having a linear density of about 40 denier to about 300 denier. One such suitable yarn is a 150 denier, 34 filament textured multi-filament polyester yarn although other yarn constructions may likewise be utilized if desired. In particular, in some applications it may be desirable to use so called micro denier yarns to provide enhanced cleaning performance.

As best illustrated in FIG. 3A, during an initial stage of an exemplary patterning process, the pile yarn 44 is carried in alternating fashion back and forth between a first pair of needles 34, 34' thereby forming a row of loop elements 42 as the pile yarn 44 is carried over the sinker finger 47 between the needles 34, 34' during stitch formation. Of course, if no sinker finger is used, the loop elements 42 are replaced by substantially flat crossing yarn segments which are illustrated by phantom lines immediately below the loop elements 42. As will be appreciated, as long as the pile yarn passes between the needles 34, 34' in a regular stitch forming procedure, a substantially continuous arrangement of loop elements 42 (or flat yarn segments) will be formed along the length of the fabric.

It is contemplated that the continuous formation of yarn structures may be interrupted and/or altered in a predefined manner so as to impart desired patterning in the length and/or width dimensions of the fabric. According to a practice illustrated in FIG. 3B, it is contemplated that during fabric formation the pile yarn 44 may be moved laterally or "shogged" over at least one needle by the yarn guide 46 so as to be carried back and forth between a second set of needles 34', 34" for some period after such lateral movement. As will be appreciated, the result of such lateral movement is that the pile yarn 44 is shifted over to an adjacent position relative to the previously formed yarn structures. Once this yarn shift has occurred, formation of an arrangement of loop elements 42' or other patterning yarn structures may take place along a line laterally removed from the preceding yarn structures. Of course, the pile yarn 44 may be moved laterally numerous times in virtually any pattern desired. Moreover, since the yarn shift is repeated across the fabric, a repeating pattern may be formed along the fabric.

By way of example only, in the practice illustrated in FIGS. 3A and 3B wherein the needles are not fully threaded, the yarn shift is accompanied by a so called "end out" arrangement such that the needle 34 no longer engages a pile yarn after the yarn shift takes place. Thus, the yarn shift is accompanied by a break in the formation of patterning yarn structures at the needle 34. Accordingly, in such a practice the pile yarn 44 is present only at discrete positions across the fabric thereby leaving voids with just a surface covering of base yarn stitches 40 between those areas. Of course, it is also contemplated that once shogging has occurred a new yarn may be brought into engagement with the needle 34 in which case the needle 34 may continue to make either looped or flat stitches.

Aside from the use of lateral yarn shift in combination with an end out construction to impart patterning, it is also contemplated that the lateral yarn shift may be carried out in combination with alterations in patterning at the needles. That is, the pile yarn may be handled differently at the needles before and after the yarn shift takes place. By way of example only and not limitation, it is contemplated that the patterning carried out by the needles may be such that upstanding loop elements are formed prior to the yarn shift with such loop elements being discontinued and replaced by flat yarn structures at the shifted position. As will be appreciated, such an arrangement may be achieved by simply eliminating the sinker finger 47 at the shifted location. Of course, this pattern can also be reversed if desired.

It is likewise contemplated that stitch structures may be altered during fabric formation such that the stitches themselves prevent or permit the formation of loop elements. By way of example only, it is contemplated that either before or after a yarn shift has taken place the pile yarn may be held for an extended period of formation in operative relation to a single needle so as to form a chain stitch or other flat stitch structure in the machine direction during such period. As will be appreciated, such cessation in the formation of loops for a period of time during fabric formation gives rise to a horizontal break in the cross machine direction. Of course, patterning control at the needles may also be carried out in combination with an end out construction to permit further freedom in the development of complex patterns.

By way of example only, it is contemplated that block elements may be formed by forming loop elements along a first set of needle lines for a predefined period of time and thereafter shifting to an adjacent set of needle lines for some predefined period of time before moving back to the initial set of needle lines. If the pile yarn 44 is shogged over to adjacent needles in a substantially progressive step-wise manner, a diagonal pattern of loop elements may be formed. Thereafter, progressively shogging back to the initial needle position gives rise to zigzag pattern.

In combination with the establishment of patterning in the machine direction, horizontal (i.e. cross-machine direction) breaks in patterns may be established by forming flat stitches at the threaded needles for a pre-established period between periods of loop formation. Likewise, longitudinal (i.e. machine direction) breaks may be established by use of end-out threading arrangements along predefined needle lines and/or by forming flat stitches along selected needle lines either continuously or for selected periods of time during fabric formation. Thus, by combining these techniques a wide array of surface patterns may be formed including raised loop zones and flat zones as desired.

As indicated previously, it is also contemplated that the stitching yarns may be disposed through the substrate layer in a so called "drop stitch" construction with a polymer locking layer at least partially surrounding portions of the stitching yarns disposed below a substrate layer thereby locking the stitching yarns in place. Such a construction may reduce or eliminate any structural importance for use of a ground yarn system thereby facilitating the use of a single bar structure, although multiple bar structures may still be beneficial for other performance characteristics.

One exemplary practice for forming a composite material which may thereafter be used as a cleaning or personal care article is illustrated in FIGS. 4A-4D. As illustrated, in this process a loop-forming yarn 132 does not engage the fingers of the sinker bar 138. Rather the sinker bar 138 is used primarily to hold the substrate 130 in place as the yarn is periodically pulled through the substrate 130 so as to form a plurality of looped node elements 134 across the back side or so-called "technical face" of the substrate 130.

In the practice illustrated in FIGS. 4A-D, a substrate 130 such as described above is conveyed under tension to a needle engagement position at which a reciprocating needle 136 moves through the substrate. During formation, a plurality of stitching yarns such as the pile yarns described above are carried by dynamic yarn guides 131 and are engaged by reciprocating needles at a position above the substrate 130. While for ease of reference only a single needle 136 disposed behind a sinker bar finger is illustrated, it is to be understood that in actual practice a plurality of needles 136 and corresponding yarns 132 are normally disposed across the width of the substrate 130 (i.e. in the cross machine direction) between spaced sinker bar fingers.

In the illustrated practice the needle 136 pierces the substrate 130 and engages the yarn 132 supported by a moveable yarn guide 131 at a position above the substrate 130 such that the yarn 132 is captured within a hook portion of the needle 136 (FIG. 4A). As the needle 136 is reciprocated downwardly, a closing element 137 such as a closing wire which moves relative to the needle 136 closes the hook portion to hold the stitching yarn therein as it is pulled through the substrate 130. No immediately preceding stitch is disposed around the shank of the needle 136 below the substrate 130. Thus, as the stitching yarn 132 is pulled through the substrate 130 and away from the underside of the substrate 130, a loop 134 is thereby formed across the technical face (FIG. 4B).

After formation of the loop 134, the needle 136 is raised and the hook portion is reopened thereby permitting the loop 134 formed on the downstroke to slide out of the hook portion and around the shank of the needle 136 (FIG. 4C). On the next downstroke, the yarn guide 134 is shifted away from the needle path such that the yarn 132 does not engage the needle 136. As the needle 136 travels downwardly, the previously formed loop 134 is knocked off of the needle 136 (FIG. 4D). A series of discrete loops 134 is thus formed across the technical face with intermediate yarn segments 145 extending between the loops 134 across the technical back.

As will be appreciated, during the downstroke of the needle 136 when the yarn is not engaged, it is contemplated that the yarn 132 may either remain disengaged from any needle or may engage an adjacent needle (not shown). In the event that an adjacent needle is engaged, the yarn 132 is pulled through the substrate 130 and forms a loop in adjacent diagonal relation to the first formed loop. Of course it is to be understood that any number of arrangements for the engagement and disengagement of the yarn 132 by needles 136 may be used to form a desired concentration and pattern of loops 134 across one side of the substrate 130 with intermediate yarn segments 145 disposed across an opposing side of the substrate 130.

By way of example only, in FIG. 5A a needle point diagram is provided illustrating a half threaded tricot stitch arrangement as may be used. As will be appreciated by those of skill in the art, in this arrangement loops are formed at every other needle point along needle lines with the yarn 132 shifting back and forth between adjacent needle lines. Another contemplated arrangement is illustrated in FIG. 5B. In this arrangement the yarns 132' form loops so as to define an arrangement of nodes at needle points disposed along multiple lines before shifting back to the starting needle line. It is also contemplated that the yarns need not shift between needle lines in which case the yarns will be arranged in a straight line along the machine direction with a profile geometry corresponding generally to a sine wave.

By using any of these insertion arrangements, a construction may be formed in which the yarn intentionally skips engagement with the needle in a needle line according to a predefined sequence thereby avoiding the formation of a substantially continuous stitch pattern along the needle line. Of course, loop forming arrangements other than those illustrated may likewise be utilized if desired. Generally, it is contemplated that any number of partially threaded yarn insertion patterns may be utilized where engagement between the yarn 132 and the needle 136 is skipped at one or more needle points between loops along each needle line. By selectively starting and stopping yarn engagement with the needles across the width of the substrate 130, complex patterns of loops may be formed.

As will be appreciated by those of skill in the art, the failure of the yarn 132 to engage the needle 136 at each needle point along the needle line gives rise to a so-called "drop stitch" phenomenon. Such a drop stitch would normally be considered to be a defect in a traditional product due to the fact that the loop formed lacks an anchoring relation across the side of the substrate facing away from the loop. That is, the intermediate yarn segments 145 extending across the technical back are not stitched into a cooperating structure across the technical back. The intermediate yarn segments 145 can thus be pulled freely away from the technical back which in turn permits the associated opposing loops 134 to be pulled out of the technical face.

Due to the fact that the yarn 132 is not anchored in place within the substrate 130, it is contemplated that a backing layer 140 such as a preformed polymeric adhesive film, thermoplastic coating, heat curable dispersion or the like may be applied across the technical back of the material as it is formed. Of course, it is contemplated that other stabilizing materials may likewise be utilized if desired. By way of example only, according to one contemplated practice, the backing layer may be a thermoplastic coating applied by a continuous slot die or extrusion coater as will be well known to those of skill in the art. One such thermoplastic coating may be made up of a low density polyethylene (LDPE) polymer although other materials may likewise be utilized. As will be appreciated, in such a construction the backing layer is melt bonded in affixed relation to the side of the substrate 130 facing away from the loops 134. According to another contemplated practice, the backing layer may be an aqueous dispersion such as SBR latex applied by a spraying or roll coating process.

In the exemplary arrangement illustrated in FIGS. 4A-4D, the introduction of the backing layer is illustrated as taking place substantially in line with the formation of the loops 134. It is contemplated that such an arrangement may be particularly useful if the backing layer 140 is in the form of a preformed adhesive sheet or the like. If the backing layer is to be introduced in the form of a dispersed coating such as by use of a slot die extruder or the like, it is contemplated that such application may be carried out more efficiently on a separate coating line.

When applied to the formation of a cleaning or personal care article, the formation practices outlined above facilitate the development of complex patterns of two dimensional and three dimensional zones across an operative surface of the article. Moreover, due to the flexibility of yarn selection, different combinations of yarns can be used in different zones thereby imparting different character to different zones. Of course, the array of loops formed across the surface may likewise be substantially uniform if desired.

By way of example only, one contemplated textile sheet element 260 defining a cleaning or personal care element is shown in FIG. 6. In such a construction an active treatment zone 262 for use in cleaning or other treatment is disposed at an interior portion with perimeter connection zones 264 disposed outboard of the active treatment zone 262. As illustrated in FIG. 7, the textile sheet element 260 may be segmented from a continuous sheet structure formed using techniques as previously described to provide various patterns. By way of example, the continuous sheet structure may be formed on a stitch bonding or other suitable machine and thereafter cut along first segment lines 267 extending along the machine direction and second segment lines 269 extending in the cross-machine direction to yield the individual textile sheet element 260. Of course, virtually any patterning and segmentation technique may be used as desired.

As illustrated in FIG. 6, the active treatment zone 262 may include a multiplicity of sub-zones formed by loops or other projections of varying character. By way of example only, in the construction illustrated in FIG. 6, the active treatment zone 262 includes a pair of scouring edge zones 266 and a central particle collection zone 268. Of course each sub-zone may be still further divided into discrete segments of different character if desired. Moreover, as previously indicated, the zones may include combinations of two dimensional and three dimensional segments if desired. Thus, a virtually unlimited number of combinations exist.

By way of example only, FIGS. 9-12 illustrate various patterns that can be used across a textile sheet element 260 or portions thereof. In FIG. 9, a pattern 284 is provided wherein zones of different loop character or zones of loops and loop-free zones are arranged in generally horizontal bars. In FIG. 10, a pattern 285 is provided wherein zones of different loop character or zones of loops and loop-free zones are arranged in generally diagonal bars. In FIG. 11, a pattern 286 is provided wherein zones of different loop character or zones of loops and loop-free zones are arranged in generally vertical bars. In FIG. 12, a pattern 287 is provided wherein zones of different loop character or zones of loops and loop-free zones are arranged in a generally zigzag configuration. Of course, virtually any other combination of these or other patterns may likewise be utilized if desired. Moreover, it is to be understood that in any zone described as incorporating loops, such loops may be substituted with non-looped projection elements if desired.

As will be appreciated, by varying the character and/or presence of the loops or other projection elements across the structure, particular performance characteristics may be realized. By way of example only, in the textile sheet element 260 illustrated in FIG. 6, the scouring edge zones 266 may include a percentage of yarns of enhanced stiffness relative to the particle collection zone 268. Such enhanced stiffness may be achieved by using a percentage of relatively high denier yarns. Alternatively, enhanced stiffness may be achieved by employing a percentage of partially oriented yarns, low melting point yarns or other yarn structures prone to shrinkage and consolidation upon application of heat treatment. In such a construction the textile sheet element 260 may be formed and thereafter subjected to heat treatment at which time a percentage of the fibers partially melt and/or retract inwardly thereby generating nodules of enhanced stiffness and scouring capacity. It is also contemplated that different zones may incorporate projecting structures of different shapes such as hooks, loops and/or straight fibers to provide selective surface character at different zones. It is also contemplated that different yarn elements may be used at different zones to provide selective wicking action for capillary movement of fluids to and from the face.

As shown in FIG. 8, the individual textile sheet element 260 may be disposed in at least partial wrap around relation to a support head 280 such as may be operatively connected to a user manipulated handle 282 as will be well known to those of skill in the art. In such an arrangement the perimeter connection zones 264 may be inserted into slots or other openings or otherwise attached to the support head 280. Of course, the textile sheet element 260 may likewise be used by itself or in combination with a support not attached to a handle if desired.

Figure 13:
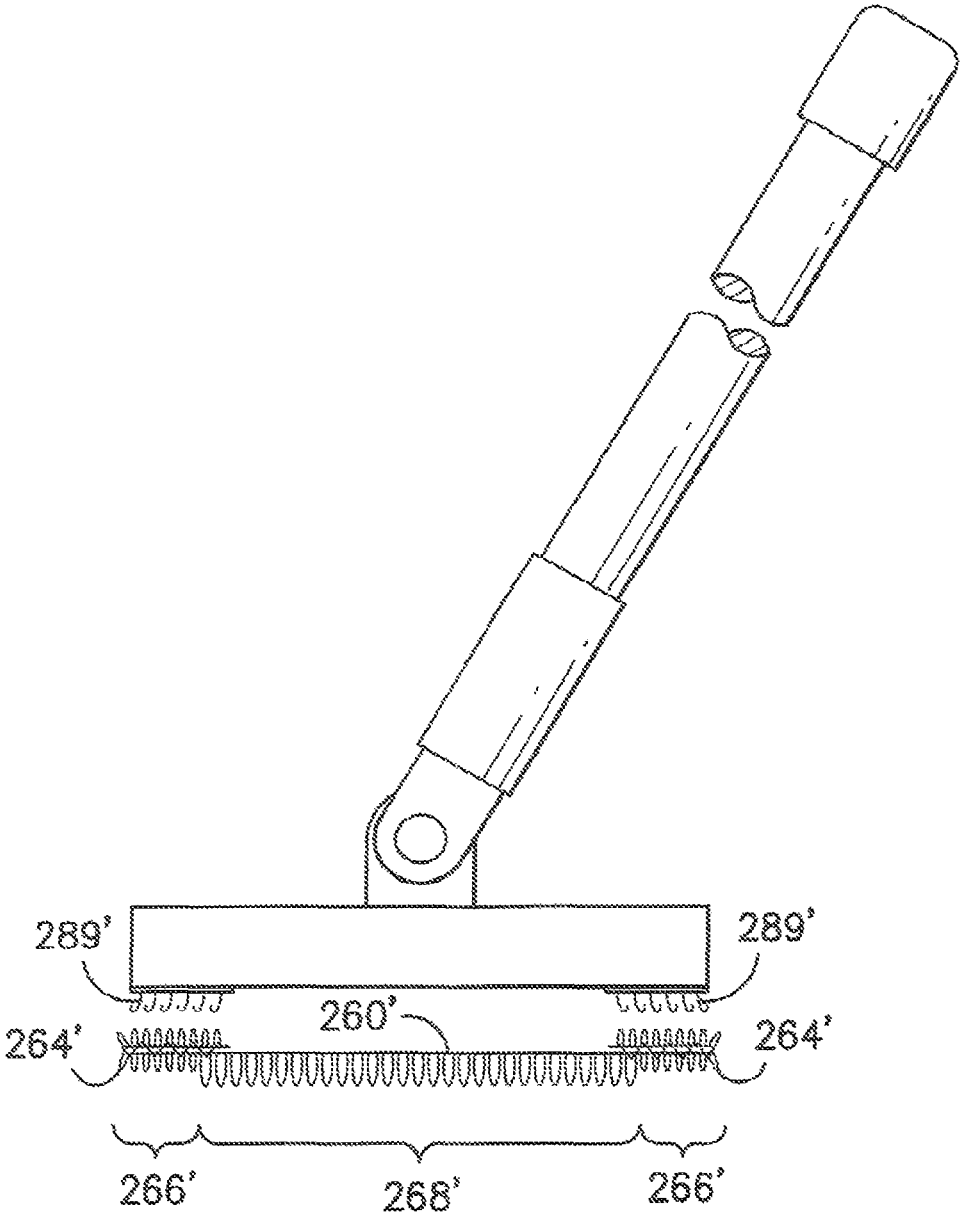
FIG. 13 illustrates an exemplary sheet structure having folded edges adapted to be secured across a surface of a mop or other manipulated device.

Of course, it is contemplated that any number of connection techniques may be used to secure the cleaning element to a user manipulated support. One such exemplary arrangement is illustrated in FIG. 13. As shown, in this construction the edges 264' of a textile sheet element 260' may be provided with outwardly projecting loops. The edges my then be folded over to define one half of a hook and loop connection for attachment to complementary hooking elements structure on a support head. In the illustrated construction scouring edge zones 266' and collection zone 268' continue to define an active treatment zone. The folded overlap may be held in place by stitching, adhesive bonding or other connection technique as may be desired.

As noted previously, the yarns forming the loops or other projections may be uniform or variable across the surface of the textile sheet element. By way of example only, it is contemplated that in some locations it may be desirable to use multi-ply yarns with two or more constituents. By way of example only, one constituent may be a relatively soft and/or absorbent ply while another constituent may be a relatively stiff filament to impart a scouring action. It is also contemplated that in some locations it may be desirable to use yarns incorporating combinations of fibers to generate a so called triboelectric effect thereby improving particle attraction and retention.

It is contemplated that at least a portion of the yarns forming the loops or other projections and/or the substrate may be selected to enhance absorption and retention of fluids and/or particles. By way of example only, it is contemplated that at least a portion of the yarns forming the loops or other projections may be of multi-lobal perimeter profile such a 4DG yarn or the like. It is likewise contemplated that the substrate may include combinations of materials. In this regard, according to one contemplated exemplary construction illustrated in FIG. 14, the substrate may have an upper layer 292 of substantially open pore hydrophobic material such as polyester or the like with an underlying layer 294 of closed pore hydrophilic material such as rayon, or other cellulosic material. In such a construction the yarns 244 forming the loops or other projections thus serve the function of wicking fluids into the absorptive layer where they are contained while the hydrophobic layer remains substantially dry and retains particles due to the relatively large pore size.

It is also contemplated that at least a portion of the yarns forming the loops or other projections and/or the substrate may be selected to promote controlled discharge of previously stored agents during use. By way of example only, it is contemplated that agents such as cosmetics, lotions, exfoliating agents, oral hygiene agents, topically applied pharmaceutical agents, cleaning solutions or the like may be stored within depressions along multi-lobal perimeter profile yarns such as 4DG yarn or the like. It is likewise contemplated that agents may be stored within the substrate such that the substrate acts as an expulsion reservoir during use. Various agents may be present at different sets of yarns and/or within the substrate such that multiple agents may be combined and/or activated on demand such as by application of heat, pressure or other activating condition.

While it is contemplated that surface loop elements may be desirable for many applications, the present invention is in no way limited to a surface loop construction. Rather, it is contemplated that any number of other outwardly projecting structures may also be beneficial. In this regard, it is contemplated that at least a portion of the yarns 344 forming projections in one or more zones across the cleaning element may have an open ended configuration such as a "J" structure or the like extending through a substrate 330 as shown in FIG. 15. As will be appreciated, such structures may be formed by first forming loops and then subjecting a portion of those loops to abrasion or other treatment to break the loops. It is contemplated that such open ended constructions may promote particle retention in some circumstances.

As will be appreciated, the present invention provides a wide range of potential benefits and is adaptable to a wide rage of constructions and uses. By way of example only, potential functions include collection of dust, dirt, soils, soap scum and the like; scouring or scrubbing to loosen debris; and absorbency or selective discharge of agents for cleaning and/or personal care.

The present invention has now been described with reference to several embodiments thereof. However, it will be apparent to those skilled in the art that many changes can be made in the embodiments described without departing from the scope of the present invention. Thus, in no event is the scope of the present invention to be limited to the structures and practices described in this application. Rather, it is intended that the invention shall extend to all alternatives and equivalents embracing the broad principles of this invention within the full spirit and scope thereof.

What is claimed is:

1. A cleaning textile sheet element, the textile sheet element comprising:

a substrate layer; and a plurality of ground yarns extending in stitched relation through the substrate layer to form an arrangement of ground yarn stitches disposed in spaced rows along the substrate layer, wherein the ground yarns are filament yarns having a linear density in the range of about 20 denier to about 300 denier and a denier per filament (dpf) level greater than 1; and a plurality of pile yarns comprising micro denier fibers, said pile yarns extending in stitched relation through the substrate layer in surface loop construction such that said pile yarns define a discontinuous patterned arrangement of three-dimensional surface elements projecting above the ground yarn stitches for wiping and cleaning a surface separate from the textile sheet element and wherein all three-dimensional surface elements projecting above the ground yarn stitches consist entirely of looped pile yarns comprising micro denier fibers, and wherein the pile yarns provide enhanced cleaning performance relative to yarns with a denier per filament (dpf) level greater than 1.

2. A cleaning textile sheet element of stitch-bonded construction the textile sheet element comprising:

a substrate; and a plurality of ground yarns extending in stitched relation through the substrate layer to form an arrangement of ground yarn stitches disposed in spaced rows along the substrate layer, wherein the ground yarns are filament yarns having a linear density in the range of about 20 denier to about 300 denier and a denier per filament (dpf) level greater than 1; and a plurality of pile yarns comprising micro denier fibers, said pile yarns extending in stitched relation through the substrate in surface loop construction such that said pile yarns define a discontinuous patterned arrangement of three-dimensional surface elements projecting above the ground yarn stitches, the textile sheet element including an active treatment zone for wiping a surface separate from the textile sheet element, the active treatment zone comprising a plurality of outwardly projecting yarn elements disposed across an interior portion of the textile sheet element and a pair of two-dimensional attachment zones disposed outboard of the active treatment zone, wherein the two-dimensional attachment zones are capable of attachment to a user manipulated support and wherein all three-dimensional surface elements projecting above the ground yarn stitches consist entirely of looped pile yarns comprising micro denier fibers, and wherein the pile yarns provide enhanced cleaning performance relative to yarns with a denier per filament (dpf) level greater than 1.

3. The invention as recited in claim 2, wherein said substrate is a multi-layer structure comprising a first layer of substantially open-pore hydrophobic character and a second layer of substantially hydrophilic character.

* * * * *